US005894053A

United States Patent [19]

Fried

[11] Patent Number: 5,894,053

[45] Date of Patent: Apr. 13, 1999

[54] PROCESS FOR APPLYING A METALLIC ADHESION LAYER FOR CERAMIC THERMAL BARRIER COATINGS TO METALLIC COMPONENTS

[75] Inventor: Reinhard Fried, Nussbaumen, Switzerland

[73] Assignee: ABB Research Ltd., Zurich, Switzerland

[21] Appl. No.: 08/743,936

[22] Filed: Nov. 5, 1996

[30] Foreign Application Priority Data

Dec. 2, 1995 [DE] Germany ..... 19545025

[51] Int. Cl.[6] ..... B22F 7/00; B05D 3/00

[52] U.S. Cl. ..... 428/548; 428/552; 428/553; 428/558; 427/191; 427/201; 427/203; 427/205; 427/327; 427/446; 427/455; 228/205; 228/208; 228/254; 228/119

[58] Field of Search ..... 428/546, 548, 428/552, 553, 558; 228/119, 205, 903, 208, 210, 254; 427/455, 532, 189, 190, 191, 201, 205, 327, 446, 203, 453

[56] References Cited

U.S. PATENT DOCUMENTS 4,248,940 2/1981 Goward et al. .

FOREIGN PATENT DOCUMENTS

0494389A1 7/1992 European Pat. Off. .
1236345 3/1967 Germany .
2641797 4/1977 Germany .
2910962 9/1980 Germany .
3015867 11/1980 Germany .
4417384C1 1/1995 Germany .
2049484 12/1980 United Kingdom .
2269393 9/1993 United Kingdom .
2267244 12/1993 United Kingdom .

OTHER PUBLICATIONS

"TBCs for better engine efficiency", Brindley, et al., Advanced Materials and Processes, Aug. 1989, pp. 29–33.

*Primary Examiner*—D. S. Nakarani
*Assistant Examiner*—H. Rickman
*Attorney, Agent, or Firm*—Burns, Doane, Swecker & Mathis, L. L. P.

[57] ABSTRACT

In a process for applying a metallic adhesion layer for thermally sprayed ceramic thermal barrier coatings to metallic components, the surface which is to be coated being cleaned in a first process step, so that the metallic surface is free of grease and oxide, a binder is applied to the metallic surface of the base material in a second process step. Metallic adhesive powder is applied uniformly to the binder in a third process step and solder powder, which has a smaller particle size than the adhesive powder, is applied uniformly to the binder in a fourth process step. After drying the binder, a heat treatment is carried out for the purpose of soldering. The adhesion layers produced in this way are rough and provide a considerable positive lock for the ceramic thermal barrier coatings which are to be sprayed thereon.

29 Claims, 3 Drawing Sheets

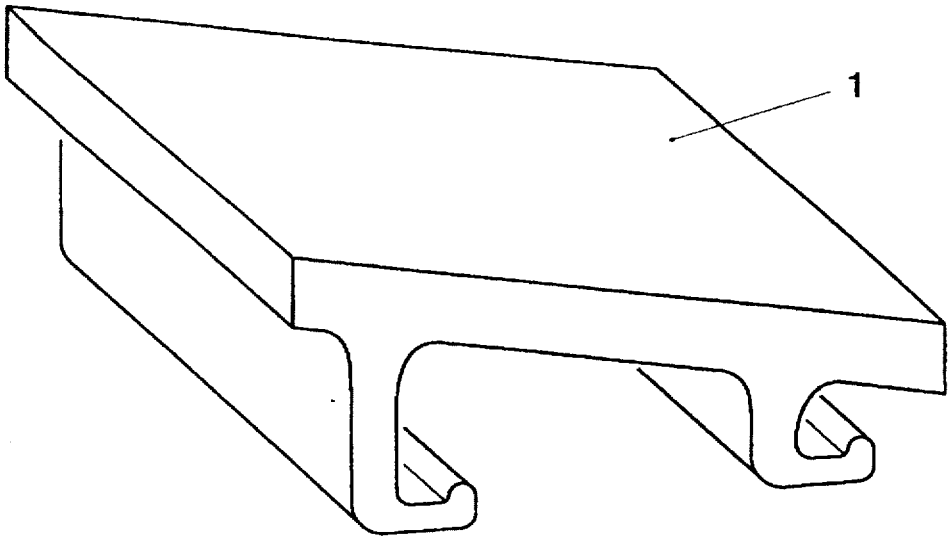
FIG. 6
FIG. 7
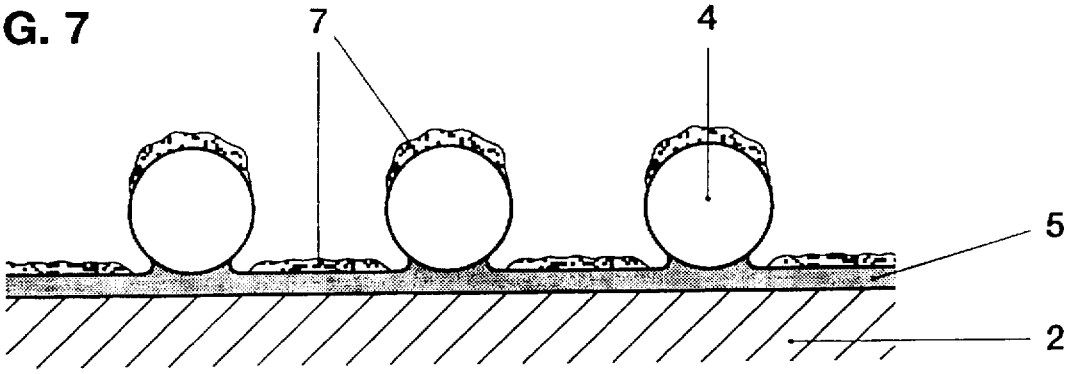
FIG. 8
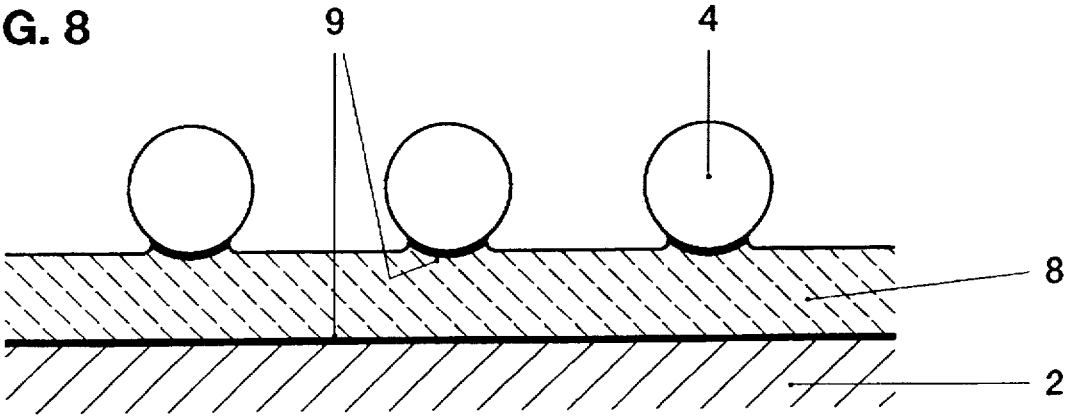

PROCESS FOR APPLYING A METALLIC ADHESION LAYER FOR CERAMIC THERMAL BARRIER COATINGS TO METALLIC COMPONENTS

BACKGROUND OF THE INVENTION

1. Field of the Invention

The invention relates to the field of materials technology. It concerns a process for applying a metallic adhesion layer for thermally sprayed ceramic thermal barrier coatings (TBC) to metallic components and a metallic adhesion layer produced in accordance with this process.

2. Discussion of Background

Normally, metal and ceramic cannot be joined to one another owing to the different coefficients of thermal expansion.

It is known that, in order to solve this problem, a ductile intermediate layer is placed between the parts which are to be joined, which intermediate layer compensates for the differential expansions at different temperatures in an elastic-plastic manner (cf. W. J. Brindley, R. A. Miller: "TBCs for better engine efficiency", Nasa Lewis Research Center Cleveland, Advanced Materials & Progress 8/1989, pp. 29–33). These intermediate layers, which are designated as adhesion layers, are conventionally applied by means of known flame spraying processes, plasma spraying processes or detonation spraying processes. They make possible a metallurgical-mechanical bonding to the metallic component and a purely mechanical bonding of the likewise thermally sprayed ceramic layer to the adhesion layer, this joint exhibiting a pronounced sensitivity to impacts and thermal shocks.

Since the ceramic thermal barrier coatings protect the coated metallic components from harmful thermal stresses, it is important for a sufficient service life of the components that they be present without gaps. Components which have been coated in this manner are used in particular in the field of combustion technology, for example for combustion chamber parts or gas turbine blades.

The disadvantage of the metallic adhesion layers for ceramic thermal barrier coatings which have been produced to date is that they exhibit insufficient roughness and thus provide inadequate positive lock (undercuts), so that the layer thickness of the TBC layers is limited. Layer thicknesses of approx. 0.2 to 0.4 mm are known, layer thicknesses of about 0.3 mm being most commonly encountered. If they are thicker, the risk of flaking increases rapidly. If they are thinner, the heat insulating effect drops quickly. Although more recent developments have tended toward coarser adhesion layers (approx. 0.6 mm) being sprayed, the required positive lock is lacking.

A roughness (peak-valley height) which is typical for known metallic adhesion layers is about 30 μm. It is impossible to spray the layers any more roughly, since the size of the powder particles to be melted is limited to approx. 10 to 50 μm, depending on the coating process (different spraying temperatures and spraying speeds), and the liquid powder particles become smoothed out on striking the substrate (cf. B. Heine: "Thermisch gespritzte Schichten" [Thermally sprayed layers], Metall, Vol. 49, 1/1995, pp. 51–57).

An obvious remedy, by roughening to a coarser level by sandblasting or by changing the flame spraying parameters, is, however, limited. For example, although the layer thickness of the TBC ceramic layer can be increased by low-speed flame spraying, layers of this kind do not withstand any thermal shocks.

Rough threading or milling grooves into the surfaces to be coated, as are specified by B. Heine in the abovementioned article in order to promote adhesion with desired layer thickness of greater than 1 mm, are expensive and can be achieved only with great difficulty in the event of a complicated geometric shape of the workpiece.

SUMMARY OF THE INVENTION

The invention aims to avoid all these disadvantages. Accordingly, one object of the invention is to provide a novel metallic adhesion layer and a process for applying this adhesion layer for ceramic thermal barrier coatings to a metallic basic body, by means of which it is possible subsequently to spray thermally and to attach ceramic thermal barrier coatings of greater thickness compared with the known prior art. In this case, the layers are to adhere stably and be insensitive to the effect of impacts.

According to the invention, this is achieved in a process for applying a metallic adhesion layer for thermally sprayed ceramic thermal barrier coatings to metallic components, the surface which is to be coated being cleaned in a first process step, so that the metallic surface is free of grease and oxide, in that a) a binder is applied to the metallic surface in a second process step, b) metallic adhesive powder is applied uniformly to the binder in a third process step, c) solder powder, which has a smaller particle size than the adhesive powder, is applied uniformly to the binder in a fourth process step, and d) after drying the binder, a heat treatment is carried out for the purpose of soldering.

According to the invention, this is achieved in a process for applying a metallic adhesion layer for thermally sprayed ceramic thermal barrier coatings to metallic components, the surface which is to be coated being cleaned in a first process step, so that the metallic surface is free of grease and oxide, and an oxidation- and corrosion-resistant layer is produced on the metallic surface by means of protective gas plasma spraying in a second process step, in that a) a binder is applied to the oxidation- and corrosion-resistant layer in a third process step, b) a coarse adhesive powder of the same composition as the oxidation- and corrosion-resistant layer is applied uniformly to the binder, c) after drying the binder, a heat treatment (solution annealing) is carried out for the purpose of forming a sintered joint between the metallic component and the layer and between the layer and the adhesive powder, respectively.

The advantages of the invention include, inter alia, that adhesion layers which are extremely rough compared with the prior art are produced using these processes. The soldered-on or sintered-on metal powder particles in this case represent very stable and positively locking anchor points for the TBC layer which is to be sprayed on, so that comparatively thick, stably adhering ceramic thermal barrier coatings can be produced.

It is particularly expedient if, instead of applying the metallic adhesive powder and the solder powder successively in time, the two powders are first intensively mixed and then this mixture is applied to the metallic surface of the base material. As a result, a more uniform distribution of the powder particles is achieved and, moreover, the process time is reduced.

Furthermore, it is advantageous if a thin layer of the adhesive powder is additionally applied to the adhesion layer, after soldering has been carried out, by means of spray processes, preferably protective gas plasma spraying. This additionally provides the possibility of a fine toothing between the coarse anchoring means, which further increases the adhesion of thick TBC layers under thermal shock conditions.

Finally, material of the same kind as the base material and boron-free or low-boron solders are advantageously used as the solder material. As a result, any possible formation of brittle phases is reduced.

The process according to the invention can be used both locally for repairs and also for coating new parts.

The metallic adhesion layer produced according to the invention comprises, depending on the process variant employed, a solder layer wetting the surface of the metallic component and having adhesive powder particles of spherical or irregular form soldered fixedly therein, or additionally a thin sprayed, in particular protective gas plasma sprayed, layer made of material of the same kind as the adhesive powder particles, or a protective layer which has been protective gas plasma sprayed on the surface of the metallic component and has adhesive powder particles sintered on its surface. This metallic adhesion layer ensures a stable adhesion of the thermally sprayed ceramic thermal barrier coatings, permits greater layer thicknesses and results in good emergency running properties.

Moreover, it is advantageous if the height of the adhesive powder particles is approximately the same size as the layer thickness of the ceramic thermal barrier coating which is to be sprayed on thermally. As a result, the layer becomes virtually insensitive to impacts, since impacts are essentially taken up metallically.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 6 shows a perspective representation of a heat insulating board which is to be coated;

FIG. 7 shows a diagrammatic cross section through the various layers after soldering and flame spraying of the adhesion layer;

FIG. 8 shows a diagrammatic cross section through the various layers of a further exemplary embodiment (adhesive powder sintered on);

FIG. 9 shows a micrograph of a metallic sample with adhesion layer soldered on.

Figure 1:
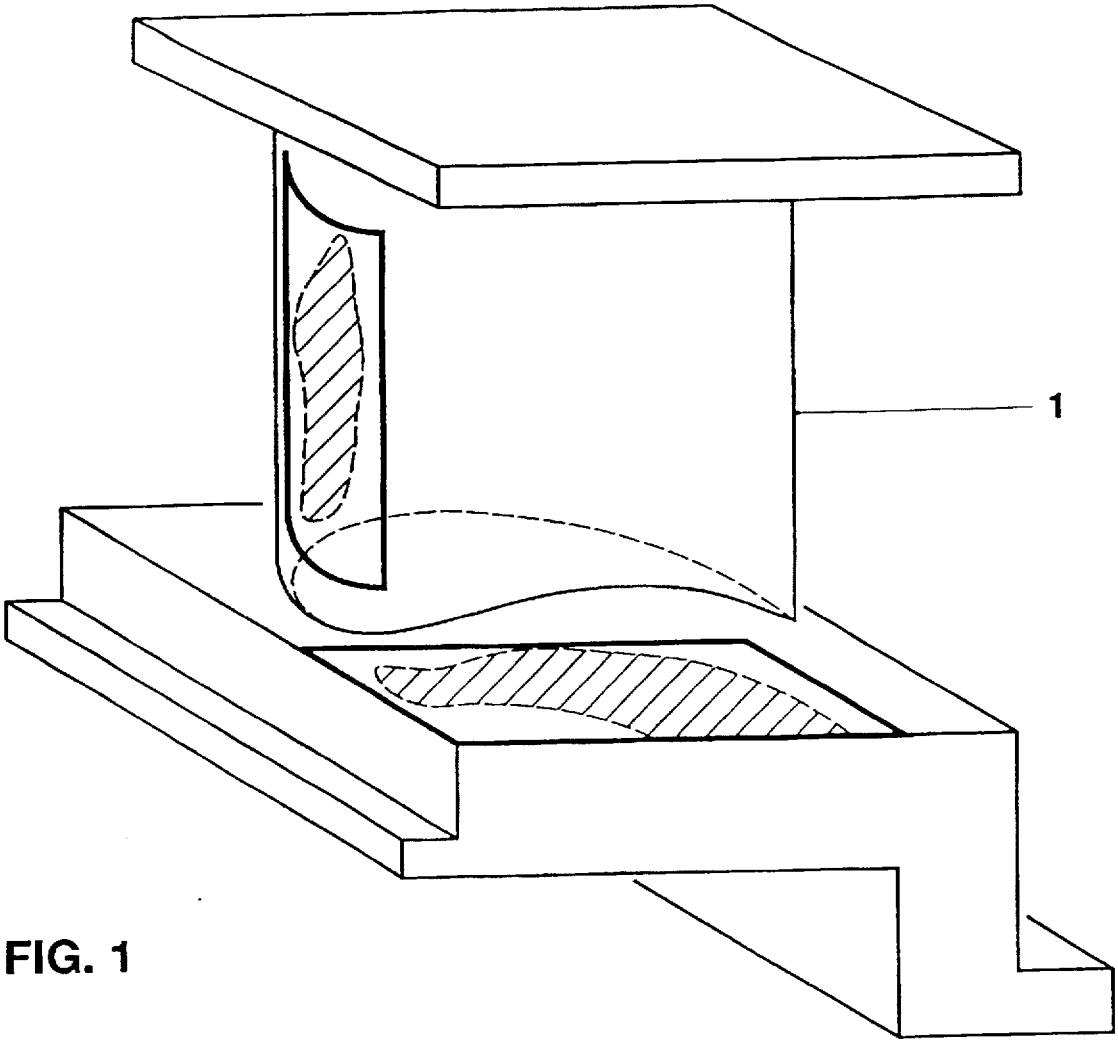
FIG. 1 shows a perspective representation of a guide vane which is to be coated.

Only the elements which are essential for an understanding of the invention are shown.

DESCRIPTION OF THE PREFERRED EMBODIMENTS

Referring now to the drawings, wherein like reference numerals designate identical or corresponding parts throughout the several views, the invention will now be explained in more detail with reference to a number of exemplary embodiments and FIGS. 1 to 9.

FIG. 1 represents a guide vane of a gas turbine as an example of a metallic component 1 which is to be coated. It comprises the metallic base material (substrate) 2, in this case the alloy IN 939 of the following chemical composition: bal. *Ni*; 22.5% *Cr*; 19.0% *Co*; 2.0% W; 1.0% *Nb*; 1.4% *Ta*; 3.7% *Ti*; 1.9% *Al*; 0.1% *Zr*; 0.01% B; 0.15% C. The vane is provided on the gas-conducting surfaces with a corrosion and oxidation layer (MC*rAlY*, e.g. SV201473: bal. *Ni*; 25% *Cr*; 5% *Al*; 2.5% *Si*; 0.5% Y; 1% *Ta*). Moreover, this vane is coated on the inlet edge, the pressure side of the blade and on the duct walls with a ceramic thermal barrier coating which is approx. 0.3 mm thick and is made of yttrium-stabilized zirconium oxide of the following composition: bal. $ZrO_2$ inc. 2.5% $HfO_2$; 7–9% $Y_2O_3$; <3% others.

After an operating time of 25,000 hours, the gas turbine guide vane is brought for reconditioning. It is then found that the thermal barrier coating is no longer present at the inlet edge of the blade and on the duct wall (cf. hatched regions in FIG. 1), owing to thermal overstressing and erosion. Since the vane exhibits no other damage, for reasons of cost it is desired not to apply a complete new coating but rather to carry out a partial repair of the thermal barrier coating. Due to the fact that the TBC is systematically attacked particularly strongly at the areas described above, the TBC layer should be made not only of the same thickness but, if possible, thicker.

This is achieved using the process according to the invention, in which the ceramic layer is bonded more flexibly to the metallic substrate 2 by graduating the metal-ceramic transition using a special adhesion layer.

First of all, the vane 1 is cleaned of coarse dirt (combustion residues) in a steam jet. Deposits which are still adhering are then removed by means of gentle sandblasting (e.g. fine aluminum powder, 2 bar jet pressure, 20 cm distance). The still intact ceramic thermal barrier coating must not be eroded in this process.

The vane parts which are not to be coated are then covered, for example with a plate template, and the surfaces which are to be coated are blasted completely clean (e.g. fine silicon carbide, jet pressure 4 bar, distance 40 mm), so that any TBC residues and any oxides are removed.

The metallic, clean surfaces which have been cleaned in this way and are free of grease and oxide are then thinly coated with an organic binder 3, so-called cement, which is customary for the production of solder pastes, with the aid of a brush, swab or sprayer. Adhesive powder 4 of the *NiAl*95/5 type with a particle size in the range from 100 to 200 μm is then scattered over the areas which have been dampened by the binder 3, until adhesive powder particles 4 of this nature are situated approximately every 0.5 mm. The much finer solder powder 5 (particle diameter approx. 10–30 μm) is then scattered in the same way. The alloy NB 150 (bal. *Ni*; 15% *Cr*; 3.5% B; 0.1% C) with a melting point of 1055° C. and a soldering range from 1065° to 1200° C. is used as the solder material. Approximately equal amounts by weight of adhesive powder 4 and solder powder 5 are advantageous, but other quantitative ratios may, of course, also be chosen. The packing density of the particles is not of decisive importance here, since dense packings are suitable, but less dense packings are also quite adequate.

Figure 2:
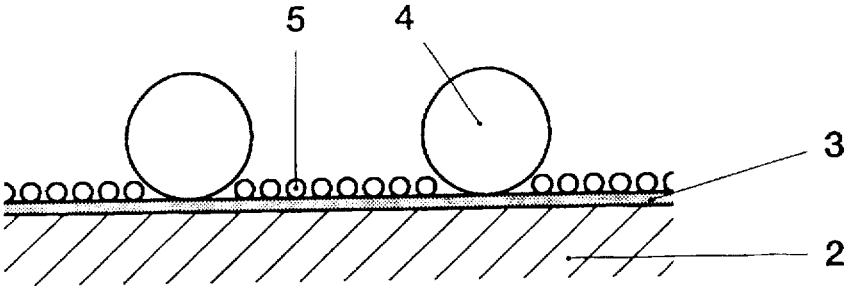
FIG. 2 shows a diagrammatic cross section through the various layers after application.

The binder 3 dries after a short time (approx. 15 min) and holds the adhesive powder 4 and the solder 5 firmly on the substrate 2. FIG. 2 shows diagrammatically a cross section of the various layers after application.

The surface which has been coated in this way can now be moved into the soldering furnace horizontally, vertically or upside down. The solder 5 and the adhesive powder 4 remain at their place of application until the solder has melted and has wetted and soldered the substrate surface and the surface of the adhesive powder particles. The soldering takes place in a high-vacuum furnace at $5\times10^{-6}$ mbar, 1080° C. and with a holding time of 15 min.

Figure 3:
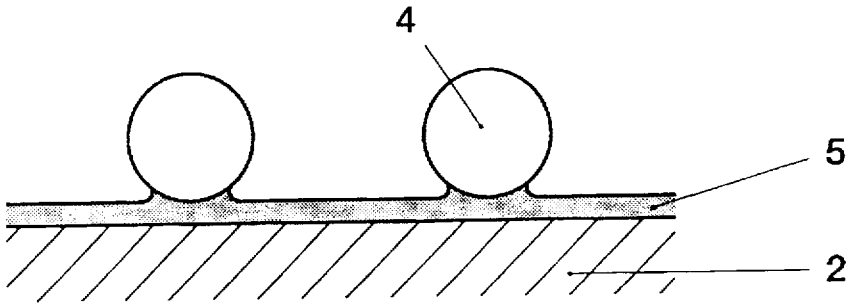
FIG. 3 shows a diagrammatic cross section through the various layers after soldering.

FIG. 3 shows diagramatically a cross section of the various layers after the soldering operation. The solder 5 has wetted the entire surface which is to be repaired and the adhesive powder particles 4 are fixedly soldered. The surface has a metallic matt bright silver appearance. The diffusion zone is only very small owing to the short soldering time and the relatively low soldering temperature.

After applying the metallic adhesion layer according to the invention, the vane is again covered with a template and provided with a 0.5 mm thick ceramic thermal barrier coating 6, here made of calcium-stabilized zirconium oxide (Meta-Ceram 28085), the zirconium oxide being applied by means of a known flame spraying process.

Figure 4:
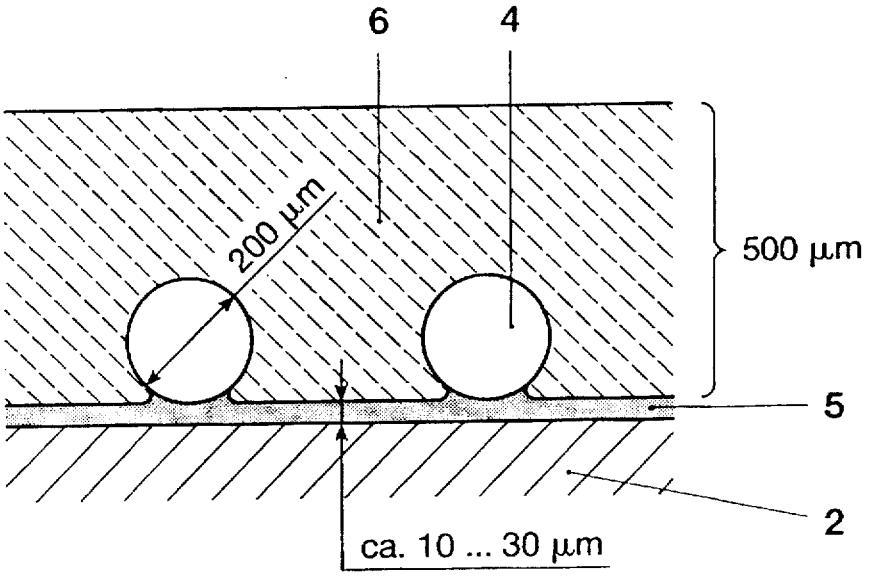
FIG. 4 shows a diagrammatic cross section through the various layers after flame spraying of the ceramic thermal barrier coating.
Figure 5:
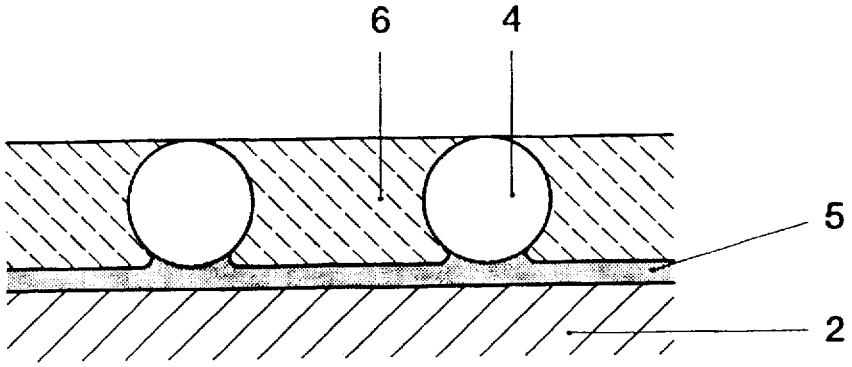
FIG. 5 shows a diagrammatic cross section through the various layers after TBC coating and lateral compressive stressing.
Figure 9:
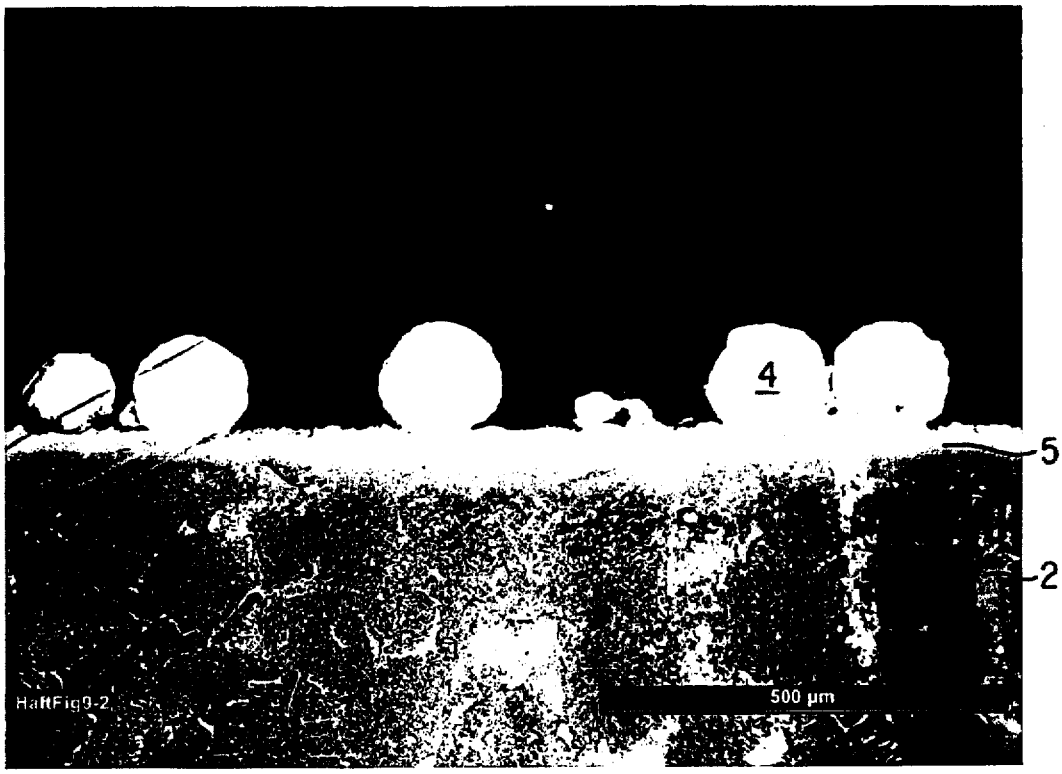
Figure 9:
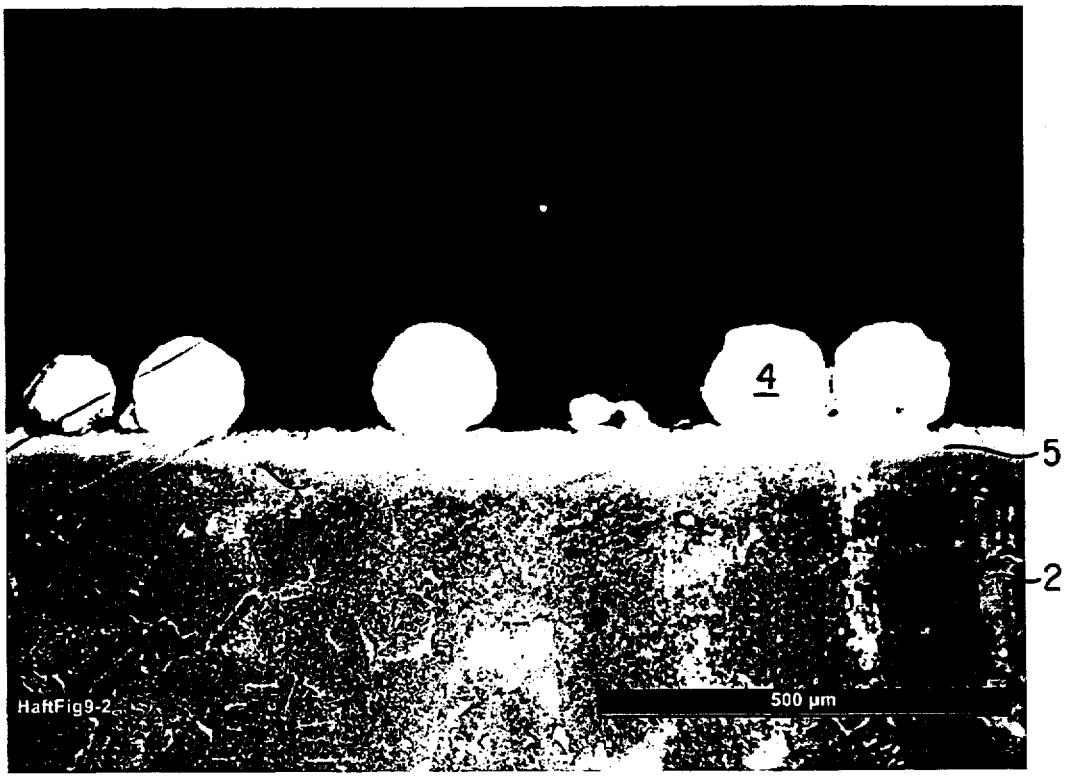

FIG. 4 shows diagrammatically the layer structure after the flame spraying process.

The attachment of the zirconium oxide can be roughly compared to a snap fastener. The zirconium oxide has a strong positive lock and a large number of undercuts, in contrast to previous conventional adhesion geometries which at most have only a slight positive lock. As a result, the zirconium oxide (TBC) layer is very stably anchored on the component. As well as plasma spraying and detonation flame spraying, as described above flame spraying is therefore also suitable for spraying the TBC layers onto the adhesion layers according to the invention. Flame spraying has the advantage that portable coating equipment can be used therefor.

A further advantage of the invention consists in the high insensitivity of the layers to thermal shocks. The metallic component 1 coated in accordance with the process described above was subsequently subjected to thermal cycles in a hot-gas stream (heating up at about 50 degrees/min gas temperature, 2 min holding at 1000° C., cooling at 100 degrees/s gas temperature to 500° C.). Even after 70 cycles, the layer has not detached at all.

Another advantage consists in the excellent emergency running properties of the TBC layers thermally sprayed onto the adhesion layer according to the invention. Under impact or lateral compressive stressing, the ceramic layer 6, i.e. in this case the zirconium oxide, only flakes above the adhesive powder 4. The TBC layer 6 does not fall out between the adhesive powder particles 4 owing to the considerable positive lock, so that the ceramic thermal barrier coating 6 is retained at least to the thickness of the adhesive powder particles 4 (approx. 200 μm). This is represented diagrammatically in FIG. 5. This result justifies the assumption that both the inlet edge and also the duct wall of the repaired guide vane is able to withstand erosion of the thermal barrier coating longer than the thinner and less well anchored original thermal barrier coating. This exemplary embodiment has proved the basic suitability of the coarsely soldered adhesion layers for the application of thermally sprayed thermal barrier coatings. When using the materials in combination with one another, it should be ensured that the oxidation- and corrosion-resistance of adhesive powder, solder and adhesion layer are, if at all possible, greater than the corresponding values of the base material.

A second exemplary embodiment of the invention is represented in FIGS. 6 and 7. FIG. 6 shows a perspective representation of a heat insulating board for the conduction of hot gases, which, when new, is to be provided with a thermally sprayed thermal barrier coating which is as thick as possible. The heat insulating board comprises the alloy MAR M 247, which has the following chemical composition: bal. *Ni*; 8.2–8.6% *Cr*; 9.7–10.3% *Co*; 0.6–0.8% *Mo*; 9.8–10.2% W; 2.9–3.1% *Ta*; 5.4–5.6% *Al*; 0.8–1.2% *Ti*; 1.0–1.6% *Hf*; 0.14–0.16% C.

First of all, the metallic component 1 which is to be coated is blasted so as to be free of oxide and rough (10 to 30 μm), using relatively coarse silicon carbide (particle diameter <200 μm). The surface which is to be coated is then, for example, brushed thinly with organic binder 3. The board 1 which is to be coated is moved backward and forward beneath a trickle spray device for coarse spherical adhesive powder 4 (SV 20 14 73 having the following chemical composition: bal. *Ni*; 25% *Cr*; 5% *Al*; 2.5% *Si*; 0.5% Y; 1% *Ta*) with a particle diameter of 150 to 300 μm, until the highly corrosion-resistant adhesive powder 4 has been uniformly distributed on the adhesion layer. On average, the individual powder particles should be 0.3 to 0.6 mm distant from one another. Owing to electrostatic charging, it is possible that a plurality of the adhesive powder particles 4 will come to rest against one another, which however is not disadvantageous for their functioning. Amdry Alloy DF 5, which in addition to the high *Cr* content has a high *Al* content with a somewhat reduced B content, is selected as solder. The precise composition is as follows: bal. *Ni*; 13% *Cr*; 3% *Ta*; 4% *Al*; 2.7% B; 0.02% Y. The solder 5 is likewise applied uniformly, by means of a suitable trickle spray device, to the surface which is to be soldered. It is also possible to mix the adhesive powder 4 and solder 5 and then to scatter the mixture on the surface on which the cement binder 3 has been spread in one process step.

The soldering is carried out in a high-vacuum furnace at 1100° C. and with a holding time of 15 min. Before the subsequent air plasma spraying of the thermal barrier coating 6, a thin layer 7 (approx. 50 μm) of SV 20 14 73 is applied by means of protective gas plasma spraying. In addition to the coarse anchoring means (as in exemplary embodiment 1), this additionally results in a fine toothing, which further increases the adhesion of thick TBC layers under thermal shocks.

FIG. 7 shows diagrammatically the formation of these layers.

A 1.5 mm thick yttrium-stabilized zirconium oxide layer is then sprayed as the TBC layer 6 by means of a known air plasma spraying process.

The component which has been coated in this way proved to be resistant to thermal shocks in a thermal shock test in a sand bed (1000° C. to room temperature).

Although the layer of solder is somewhat corroded away between the large adhesive powder particles after a relatively long operating time, the corrosion attack cannot significantly reduce the bearing part of the neck of solder.

In a third exemplary embodiment, a new cooled guide vane, which comprises the material CM 247 LC DS (chemical composition: bal. *Ni*; 8.1% *Cr*; 9.2% *Co*; 0.5% *Mo*; 9.5% W; 3.2% *Ta*; 0.7% *Ti*; 5.6% *Al*; 0.01% *Zr*; 0.01% B; 0.07% C; 1.4% *Hf*), is to be provided with a 0.7 to 0.8 mm thick TBC layer.

To this end, the vane is coated over the entire duct area by means of protective gas plasma spraying with the powder ProXon 21031 (nickel-based alloy) to a thickness of about 0.2 mm (low-oxygen spraying). Due to its high aluminum content and chromium content, this powder has an excellent oxidation and corrosion resistance. A thin layer of binder 3 is then applied to this roughly sprayed oxidation and corrosion protective layer 8. A coarse adhesive powder 4 with a particle diameter of about 100 to 200 μm of the same composition is then scattered on this. The coating is then carried out in a high-vacuum furnace under solution annealing conditions for CM 247 LS DS (several hours at 1220° to 1250° C.). A definite metallurgical bonding (sintered joint 9) of the oxidation and corrosion protective layer 8 on the base material 1 is thus formed. The layer 8 is compacted further and the coarse adhesive powder particles 4 are bonded on the layer 8, which is now simultaneously a protective and adhesion layer, by the formation of a stable sinter 9.

FIG. 8 illustrates this in a diagrammatic representation of the individual layers.

The profile suction side and the regions of the cooling air bores of the guide vane are then covered. The pressure side and the duct walls, which are covered by adhesion layer powder 4, are then coated to a thickness of approx. 0.8 to 0.7 mm with MetaCeram 28085 (zirconium oxide/calcium-stabilized) by means of the known flame spraying system CastoDyn DS 8000.

Even after 1000 thermal cycles in a fluidized bed (conditions: 1000° C./RT/1000° C., cycle time: 6 min), it was not possible to observe any damage to the coating.

In a fourth exemplary embodiment, a cooled guide vane made of CM 247 LC DS is likewise to be provided with a thermal barrier coating. The solder 5 used for attaching the coarse adhesive powder particles 4 made of ProXon 21031 is a powder CM 247 of the same kind with an addition of 6% *Cr*; 3% *Si*; 2% *Al* and 0.5% B. The application is carried out as described above, i.e. the adhesive powder 4, the particles of which are about 150 to 200 μm large, is scattered on the thin cement binder layer 3 and the solder powder 5 is scattered on this in ample quantities. The vane is then subjected to a heat treatment, in which the base material 2 is solution annealed and the solder 5 is partially melted. This process includes both the γ-dissolution in the base material 2 and the fine γ-formation in the solder layer, which in this exemplary embodiment is applied more thickly and forms a corrosion and oxidation layer about 65 μm thick. An approx. 0.5 to 0.6 mm thick Y-stabilized zirconium oxide thermal barrier coating is then applied to this vane surface which has been prepared in this way, on the profile pressure side and the duct walls, by means of a known air plasma spraying process.

Thermal shock tests showed that the thermal barrier coating attached in this way is superior to a layer which has been produced conventionally. Even if, for various reasons, a piece of the TBC layer does flake away, this layer is maintained between the adhesive powder particles and thus ensures good emergency running properties. By contrast, if the TBC layer flakes in conventionally coated vanes, only minimal residues, which in no way provide a heat-insulating effect, remain on the substrate. Moreover, it has been shown to be favorable in this example to use boron-free or virtually boron-free solders, since it is barely possibly for brittle phases to be formed with W borides.

Figure 9:
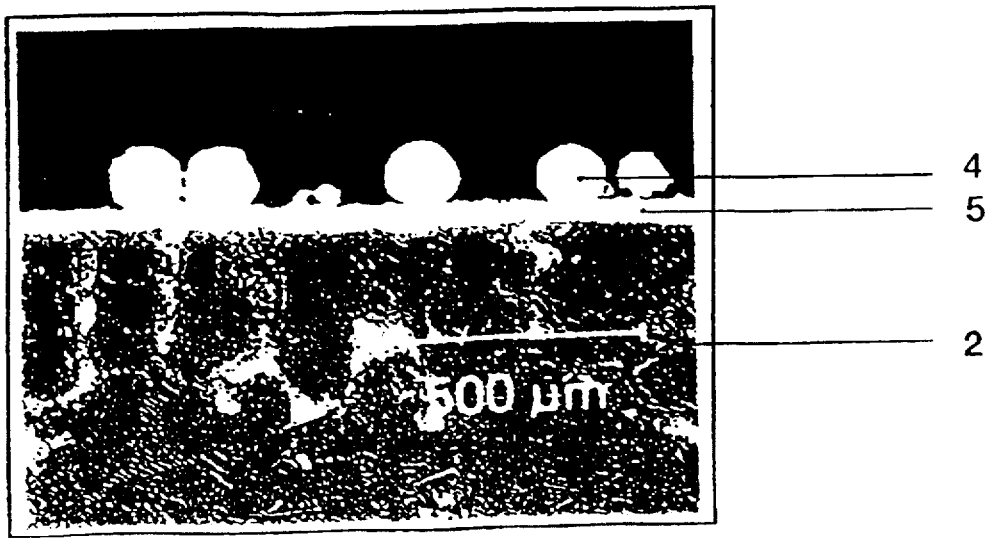

Finally, FIG. 9 shows a micrograph of a small board which has been coated with the adhesion layer according to the invention. The basic material 2 is MAR M 247, NB 150 was used as solder 5 and the adhesive powder particles 4 comprise *NiAl*95/5.

Obviously, numerous modifications and variations of the present invention are possible in the light of the above teachings. It is therefore to be understood that within the scope of the appended claims, the invention may be practiced otherwise than as specifically described herein.

What is claimed:

1. A process for applying a metallic adhesion layer for anchoring thermally sprayed ceramic thermal barrier coatings to metallic components, the process comprising:

cleaning a metallic surface of a base material which is to be coated in a first process step, so that the metallic surface of the base material is free of grease and oxide, applying a binder to the metallic surface of the base material in a second process step, applying metallic adhesive powder to the binder in a third process step, applying solder powder which has a smaller particle size than the metallic adhesive powder to the binder in a fourth process step, after drying the binder, carrying out a heat treatment which results in soldering the metallic adhesive powder to the metallic surface of the base material, the heat treatment causing the solder powder to melt and partially surround the metallic adhesive powder in a manner which allows the metallic adhesive powder to provide positively locking anchor points for a subsequently applied ceramic thermal barrier coating; and flame spraying a ceramic thermal barrier coating on the metallic adhesion layer.

2. A process for applying a metallic adhesion layer for anchoring thermally sprayed ceramic thermal barrier coatings to a metallic component, the process comprising:

cleaning a metallic surface of a metallic component which is to be coated in a first process step, so that the metallic surface is free of grease and oxide, applying an oxidation- and corrosion-resistant layer on the metallic surface by protective gas plasma spraying in a second process step, applying a binder to the oxidation- and corrosion-resistant layer in a third process step, applying a metallic adhesive powder of the same composition as the oxidation- and corrosion-resistant layer to the binder, after drying the binder, carrying out a heat treatment for the purpose of forming a sintered joint between the metallic component and the oxidation- and corrosion-resistant layer and between the oxidation- and corrosion-resistant layer and the metallic adhesive powder, respectively, the heat treatment causing the metallic adhesive powder to provide positively locking anchor points for a subsequently applied ceramic thermal barrier coating; and flame spraying a ceramic thermal barrier coating on the metallic adhesion layer.

3. The process as claimed in claim 1, wherein the metallic adhesive powder and the solder powder are mixed and then this mixture is applied to the metallic surface of the base material.

4. The process as claimed in claim 1, wherein a quantitative ratio by weight of adhesive powder to solder powder of 1:1 is used.

5. A process for applying a metallic adhesion layer for anchoring thermally sprayed ceramic thermal barrier coatings to metallic components, the process comprising:

cleaning a metallic surface of a base material which is to be coated in a first process step, so that the metallic surface of the base material is free of grease and oxide, applying a binder to the metallic surface of the base material in a second process step, applying metallic adhesive powder to the binder in a third process step, applying solder powder, which has a smaller particle size than the metallic adhesive powder, to the binder in a fourth process step, after drying the binder, carrying out a heat treatment which results in soldering the metallic adhesive powder to the metallic surface of the base material, and applying a layer of the metallic adhesive powder to the adhesion layer, after soldering has been carried out, by means of a spray process.

6. The process as claimed in claim 1, wherein material of the same kind as the base material is used as the solder material.

7. The process as claimed in claim 1, wherein boron-free solder is used.

8. The process as claimed in claim 1, wherein the process is employed for reconditioning used components.

9. The process as claimed in claim 1, wherein the process is employed for coating new parts.

10. A metallic component having a metallic adhesion layer for anchoring a thermally sprayed ceramic thermal barrier coating thereon produced using a process as claimed in claim 1, wherein the metallic adhesion layer comprises a solder layer wetting the metallic surface of the base material and having adhesive powder particles of spherical or irregular form soldered fixedly thereto.

11. A metallic component having a metallic adhesion layer for anchoring a thermally sprayed ceramic thermal barrier coating thereon produced using a process as claimed in claim 5, wherein the metallic adhesion layer comprises a solder layer wetting the metallic surface of the base material, adhesive powder particles of spherical or irregular form soldered fixedly to the metallic surface, and a sprayed layer made of the same composition as the adhesive powder particles.

12. A metallic component having a metallic adhesion layer for anchoring a thermally sprayed ceramic thermal barrier coating thereon produced using a process as claimed in claim 2, wherein the metallic adhesion layer comprises the oxidation- and corrosion-resistant layer which has been protective gas plasma sprayed on the metallic surface of the metallic component and has adhesive powder particles sintered on its surface.

13. The process of claim 1, wherein the solder powder is applied uniformly to the metallic surface.

14. The process of claim 1, wherein the metallic adhesive powder is applied uniformly to the binder.

15. The process of claim 2, wherein the solder powder is applied uniformly to the metallic surface.

16. The process of claim 2, wherein the metallic adhesive powder is applied uniformly to the binder.

17. The process of claim 1, wherein the heat treatment is carried out at a temperature which causes melting of the solder powder.

18. A process for applying a metallic adhesion layer for anchoring thermally sprayed ceramic thermal barrier coatings to metallic components, the process comprising:

cleaning a metallic surface of a base material which is to be coated in a first process step, so that the metallic surface of the base material is free of grease and oxide, applying a binder to the metallic surface of the base material in a second process step, applying metallic adhesive powder consisting essentially of a nickel base alloy to the binder in a third process step, applying solder powder, which has a smaller particle size than the metallic adhesive powder, to the binder in a fourth process step, and after drying the binder, carrying out a heat treatment which results in soldering the metallic adhesive powder to the metallic surface of the base material.

19. The process of claim 1, wherein the metallic adhesive powder has a particle size of 100 to 300 μm.

20. The process of claim 1, wherein the solder powder has a particle size of 10 to 30 μm.

21. A process for applying a metallic adhesion layer for anchoring thermally sprayed ceramic thermal barrier coatings to metallic components, the process comprising:

cleaning a metallic surface of a base material which is to be coated in a first process step, so that the metallic surface of the base material is free of grease and oxide, applying a binder to the metallic surface of the base material in a second process step, applying metallic adhesive powder consisting essentially of a nickel base alloy to the binder in a third process step, applying solder powder, which has a smaller particle size than the metallic adhesive powder, to the binder in a fourth process step, and after drying the binder, carrying out a heat treatment which results in soldering the metallic adhesive powder to the metallic surface of the base material.

22. The process of claim 1, wherein the heat treatment is carried out at a temperature of at least about 1080° C.

23. The process of claim 2, wherein the oxidation- and corrosion-resistant layer is formed by plasma spraying a nickel-base alloy powder.

24. The process of claim 2, wherein the metallic adhesive powder has a particle size of 100 to 300 μm.

25. The process of claim 2, wherein the heat treatment is carried out under solution annealing conditions.

26. The process of claim 2, wherein the heat treatment is carried out at a temperature of at least about 1220° C.

27. The process of claim 1, wherein the heat treatment is carried out under solution annealing conditions such that the solder is partially melted and forms a solder layer, $\gamma'$ dissolution occurs in the base material, and $\gamma'$-formation occurs in the solder layer.

28. The process of claim 1, wherein the metallic component is a guide vane of a gas turbine.

29. The process of claim 1, wherein the metallic component is a heat insulating board for conduction of hot gases.

* * * * *

UNITED STATES PATENT AND TRADEMARK OFFICE

CERTIFICATE OF CORRECTION

PATENT NO. : 5,894,053
DATED : April 13, 1999
INVENTOR(S) : Reinhard Fried

It is certified that error appears in the above-identified patent and that said Letters Patent is hereby corrected as shown below:

Delete Figure 9 and substitute therefore the figure consisting of Figure 9, as shown on the attached page.

Signed and Sealed this

Eleventh Day of December, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 5,894,053
DATED : April 13, 1999
INVENTOR(S) : Reinhard Fried

It is certified that error appears in the above-identified patent and that said Letters Patent is hereby corrected as shown below:

Delete Figure 9 and substitute therefore the figure consisting of Figure 9, as shown on the attached page.

Signed and Sealed this

Eighteenth Day of December, 2001

*Attest:*

*Attesting Officer*

JAMES E. ROGAN
*Director of the United States Patent and Trademark Office*